US007353815B2

(12) United States Patent
Wei

(10) Patent No.: US 7,353,815 B2
(45) Date of Patent: Apr. 8, 2008

(54) CARTRIDGE MAGAZINE ASSEMBLY FOR AIR GUNS AND PAINTBALL GUNS

(76) Inventor: Wilson Wei, P.O. Box 24-108, Taipei (TW)

( * ) Notice: Subject to any disclaimer, the term of this patent is extended or adjusted under 35 U.S.C. 154(b) by 424 days.

(21) Appl. No.: 11/079,508

(22) Filed: Mar. 14, 2005

(65) Prior Publication Data

US 2006/0201491 A1 Sep. 14, 2006

(51) Int. Cl.
*F41A 9/61* (2006.01)

(52) U.S. Cl. ..... 124/45; 124/74

(58) Field of Classification Search ..... 124/71–77, 124/45

See application file for complete search history.

(56) References Cited

U.S. PATENT DOCUMENTS 5,477,843 A * 12/1995 Kunimoto ..... 124/73
5,711,286 A * 1/1998 Petrosyan et al. ..... 124/73
2004/0200466 A1* 10/2004 Salva ..... 124/74

FOREIGN PATENT DOCUMENTS

JP 2002081896 A * 3/2002

* cited by examiner

*Primary Examiner*—Troy Chambers
(74) *Attorney, Agent, or Firm*—Troxell Law Office, PLLC

(57) ABSTRACT

The present invention describes a cartridge magazine assembly for air guns and paintball guns, and the magazine is designed as an independent device inserted into a breech of a gun to connect a feeder of the gun. The magazine has a vertical feeding chamber at the front of the magazine, and a casing can be added onto the feeding chamber for feeding paintballs or pellets of different sizes, and a feeder spring is installed to pop a feeder bracket to define the feeding device. A bottle frame with through holes is defined at the rear of the magazine, a support is secured into the bottom of the bottle frame by a screw, and the support can be moved up and down manually or by a tool. A valve connected with a gas supply tube is installed at the top of a connector, a flexible plastic feeder case is installed a the top of the magazine or a valve member is installed at the connection of the connector and the feeding chamber, so that paintballs or pellets are fed from an end of the feeding chamber of the magazine and a gas cylinder is installed through the through holes and pushed upward by the support underneath. The value controls the compressed gas in the gas cylinder to discharge the gas from the valve tube, so as to supply powerful push for shooting when the magazine is installed into a gun, and provide an easy and quick way for loading and storing paintballs or pellets and carrying and changing the gas cylinder.

4 Claims, 5 Drawing Sheets

CARTRIDGE MAGAZINE ASSEMBLY FOR AIR GUNS AND PAINTBALL GUNS

BACKGROUND OF THE INVENTION

1. Field of the Invention

The present invention relates to a cartridge magazine assembly for air guns and paintball guns, which is designed for solving the problems of a slow and inconvenient way of loading paintballs or pellets and filling and carrying gas.

2. Description of the Related Art

Paintball and air gun shooting has become a popular outdoor activity for training individual shooting, sports shooting and teamwork. An early paintball gun or air gun usually installs a feeding device and a compressed gas chamber directly on the gun, and thus causing tremendous inconvenience on its operations such as loading paintballs or pellets and filling compressed gas. Although the feeding device and compressed gas storage chamber at later stage are installed at individual magazine instead to combine the feeding device and the compressed gas storage as disclosed in the R.O.C. Patent Publication No. 410972, it is necessary to completely remove a sealed cap for changing the compressed gas cylinder since the compressed gas storage chamber is a close chamber and the paintballs or pellets are loaded by sliding and the compressed gas passes through a sliding case before sending the paintballs or pellets to a shooting valve, and thus not only wasting gases, but also increasing the probability of gas leakage. This arrangement is still not fast and convenient enough for the operation. Furthermore, the heat dissipating effect in the close compressed gas storage chamber is poor, and the volume of the close space will be increased and the propelling force will be reduced after continuous shootings. Therefore, such prior arts require further improvements.

SUMMARY OF THE INVENTION

In view of the shortcomings of the prior arts, the inventor of the present invention based on years of experience on paintball guns and air guns to conduct extensive researches and experiments to overcome the foregoing shortcomings and seek feasible solutions for improvements and finally invented the cartridge magazine assembly for air guns and paintball guns.

The primary objective of the present invention is to provide a cartridge magazine assembly for air guns and paintball guns, and the magazine is designed as an independent device inserted into a breech of a gun to connect a feeder of the gun. The magazine has a vertical feeding chamber at the front of the magazine, and a casing can be added onto the feeding chamber for feeding paintballs or pellets of different sizes, and a feeder spring is installed to pop a feeder bracket to define the feeding device. A cylinder frame with through holes is defined at the rear of the magazine, and a support is secured into the bottom of the cylinder frame by a screw, and the support can be moved up and down manually or by a tool. A valve connected with a gas supply tube is installed at the top of the hopper, and a flexible plastic feeder case is installed at the top of the magazine or a valve member is installed at the connection of a connector and the feeding chamber, so that paintballs or pellets are fed from an end of the feeding chamber of the magazine and a gas cylinder is installed from a side of the magazine and pushed upward by the support underneath. The value controls the compressed gas in the cylinder to discharge the gas from the valve tube, so as to provide a powerful push for shooting when the magazine is installed into a gun, and provide an easy and quick way for loading and storing paintballs or pellets and carrying and changing the gas cylinder.

The secondary objective of the present invention is to provide a cartridge magazine assembly for air guns and paintball guns that has a cylinder frame with through holes defined at the rear of the magazine and a gas cylinder installed from a side of the magazine and pushed upward by a support underneath. The left and right sides of the compressed gas cylinder are interconnected to the outside, and thus having a better heat dissipating effect and preventing an increase of close space and a decrease of propelling force during continuous shootings. The invention allows users to remove the compressed gas cylinder without completely removing the cap, and thus providing a quick and convenient application for users.

Another objective of the present invention is to provide a cartridge magazine assembly for air guns and paintball guns that installs a valve to connect a gas supply valve tube or a connector with an end of the feeding chamber, so that the gas supply valve tube, plastic feeding case and the valve are integrally formed as a close interconnected structure on the magazine to prevent leakage of compressed gas at the connection between the magazine and the gun body, so as to increase the propelling force and extend the use time of the compressed gas cylinder.

DETAILED DESCRIPTION OF THE PREFERRED EMBODIMENTS

To make it easier for our examiner to understand the present invention, the following detailed description with reference to the accompanying drawings of an embodiment are given for example, but such preferred embodiment is not intended to limit the scope of the present invention.

Figure 1:
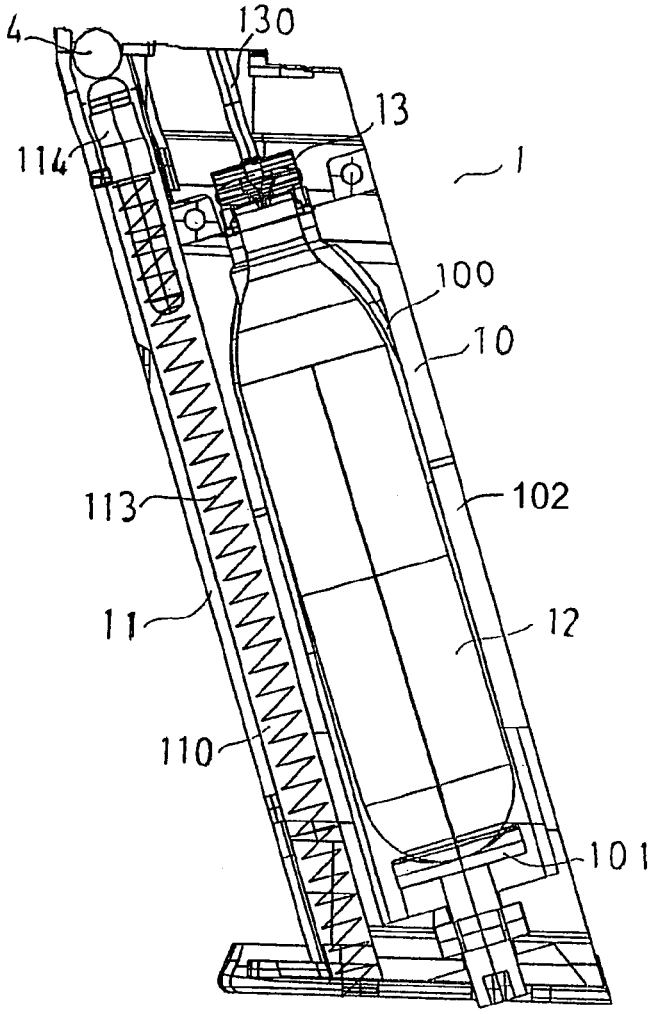
FIG. 1 is a cross-sectional view of a first preferred embodiment of the present invention.
Figure 2:
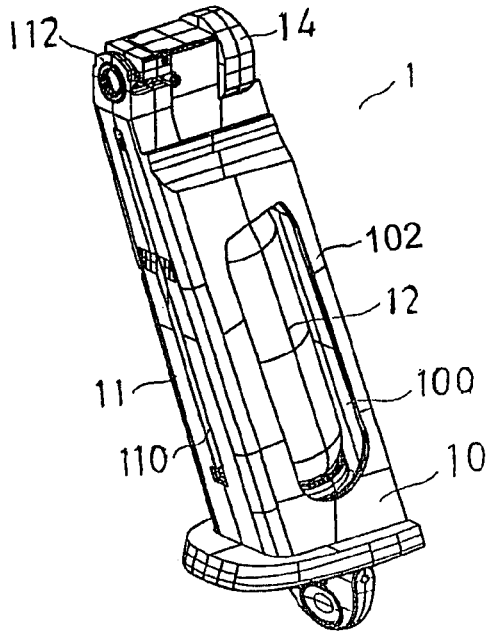
FIG. 2 is a perspective view of a second preferred embodiment of the present invention.
Figure 3:
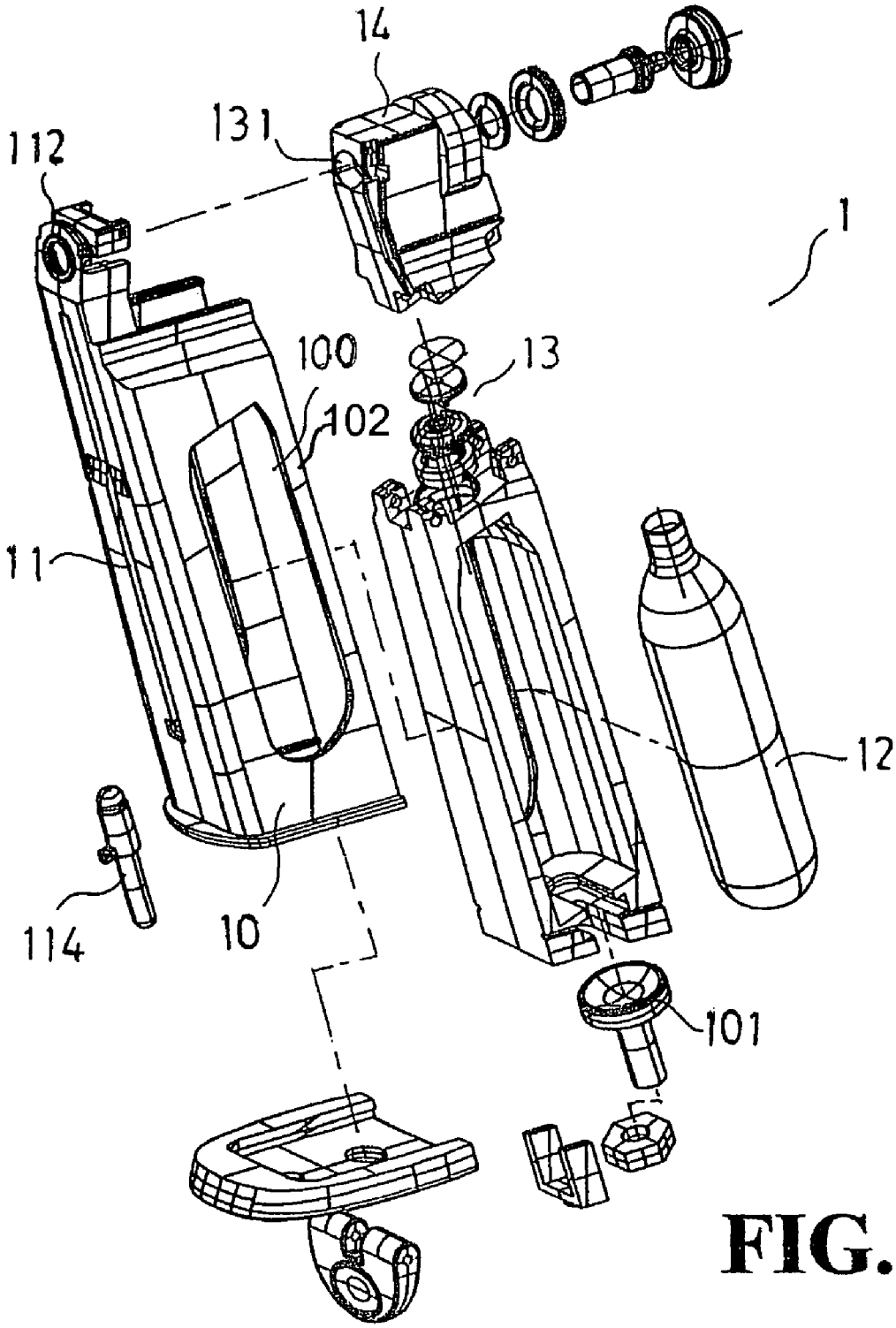
FIG. 3 is an exploded view of a second preferred embodiment of the present invention.
Figure 4:
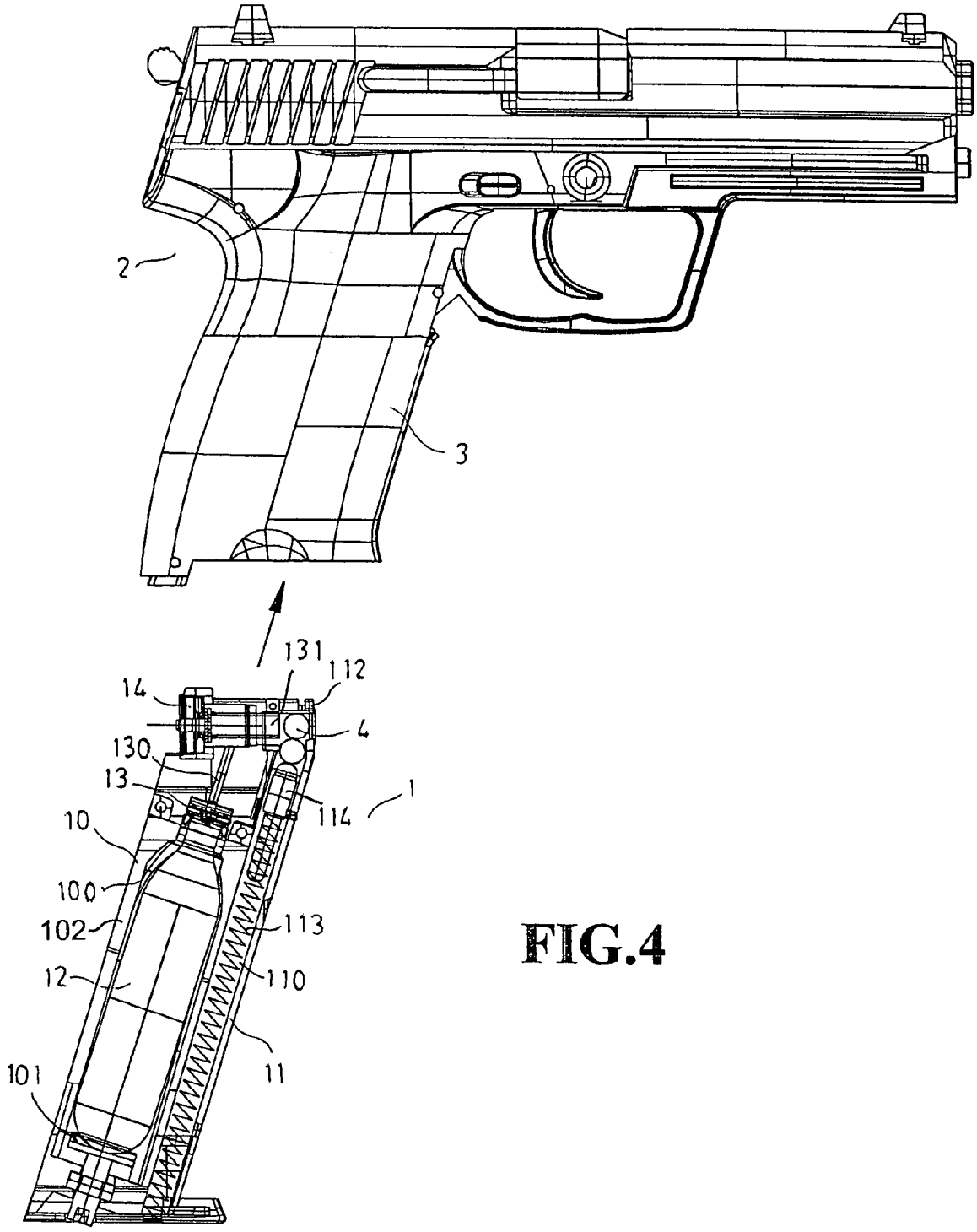
FIG. 4 is a cross-sectional side view of the connection of a gun with a second preferred embodiment of the present invention.
Figure 5:
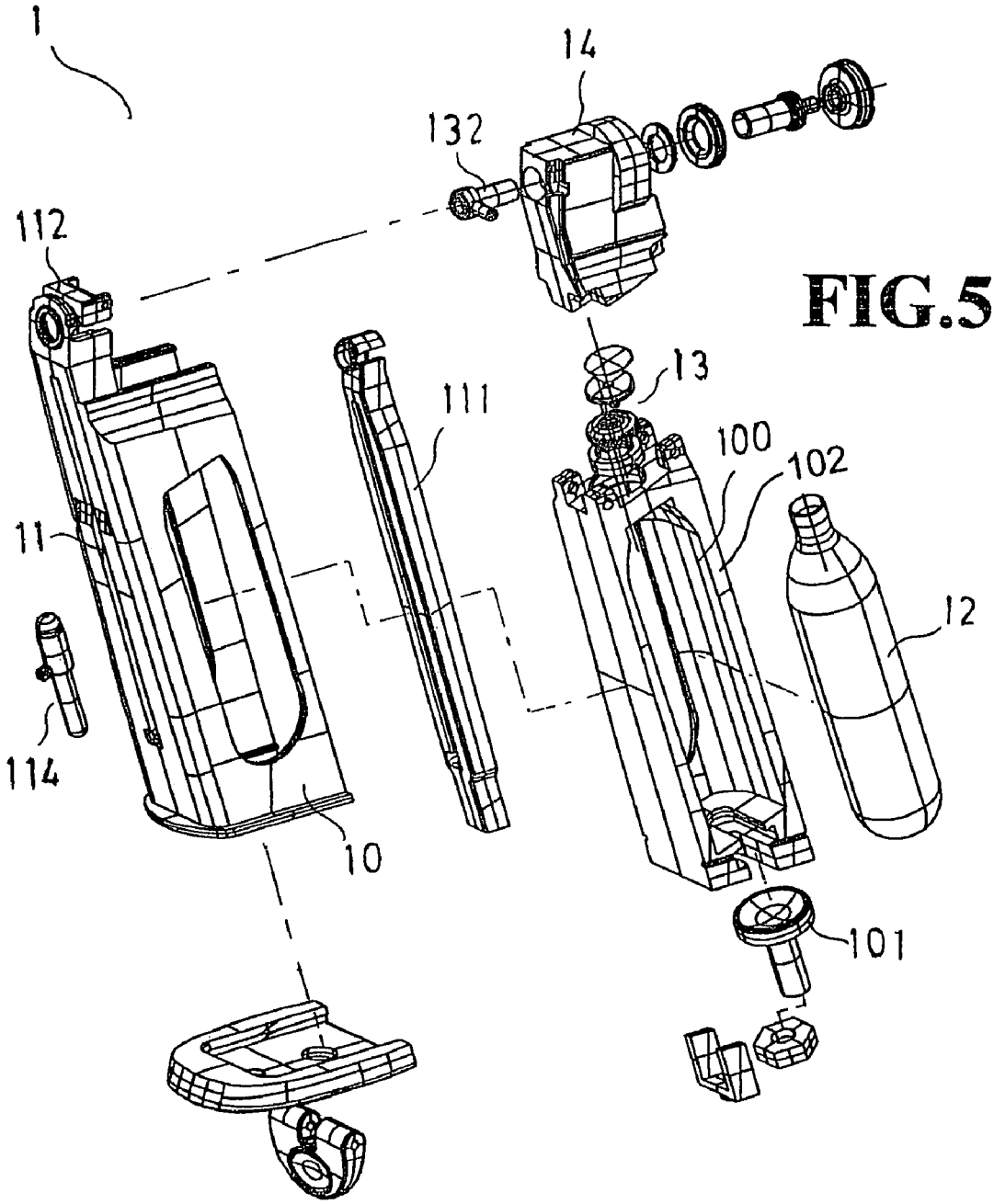
FIG. 5 is an exploded view of a second preferred embodiment of the present invention.
Figure 6:
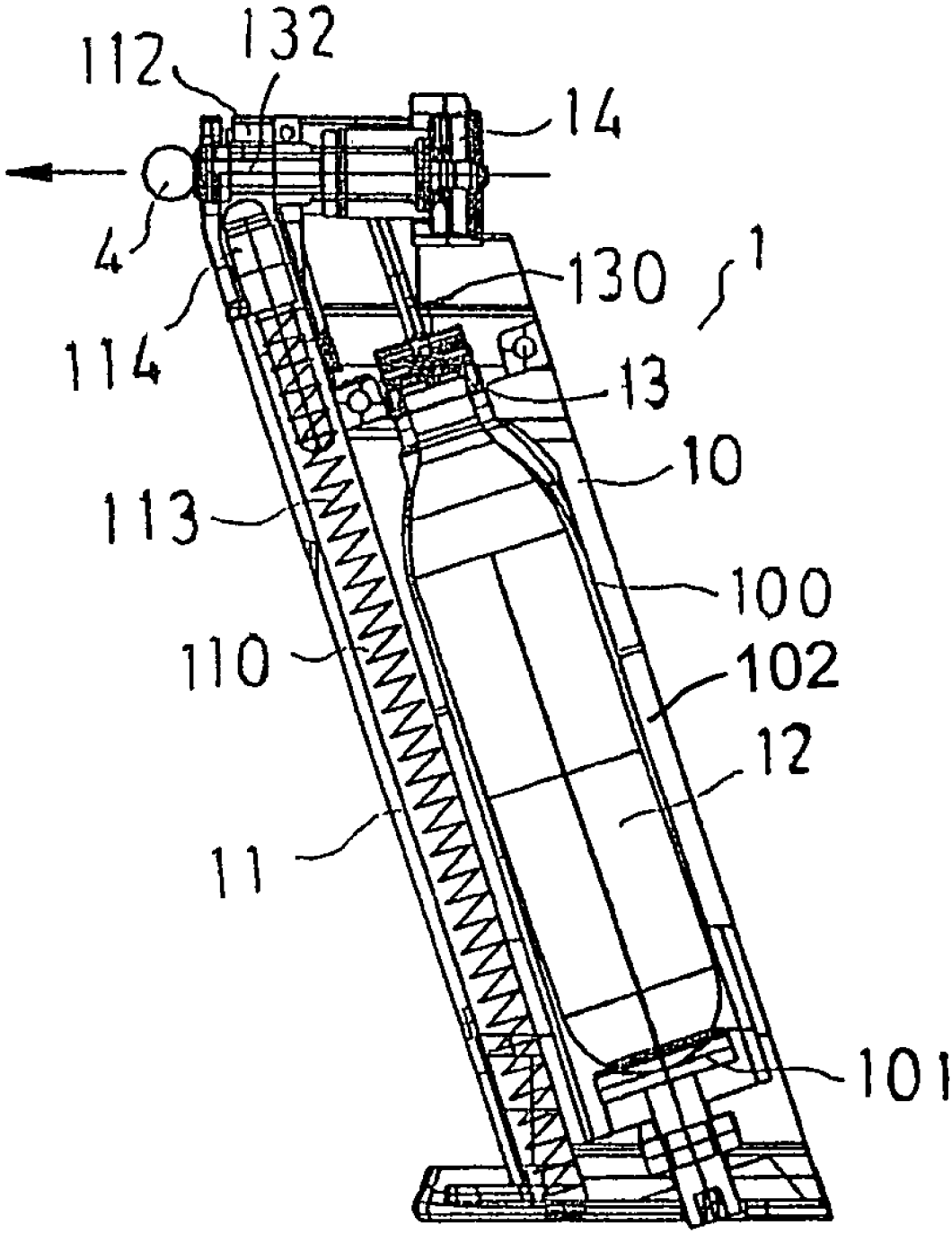
FIG. 6 is a cross-sectional side view of feeding paintballs or pellets by a hopper according to a second preferred embodiment of the present invention.

Referring to the FIGS, a magazine 1 in accordance with the present invention is designed as an independent device inserted into a breech 3 of a gun 2 to connect a shooting feeder of the gun 2. The magazine 1 comprises a magazine body 10, a feeding device 11, a compressed gas cylinder 12, a valve 13 and a valve body 14; wherein the cartridge body 10 has a vertical feeding chamber 110 disposed at the front of the magazine body 10, and a casing 111 can be added onto the feeding chamber 110 to change the hole diameter of the feeding chamber 110 for feeding paintballs or pellets of different sizes, and a feeder spring 113 is installed to pop a feeder bracket 114 to define the feeding device 11. A cylinder frame 102 with through holes 100 is defined at the rear of the magazine body 10 for installing a compressed gas cylinder 12 from a side, and a support 101 is secured into the bottom of the cylinder frame 102 by a screw, and the support 101 can be moved up and down manually or by a tool. A valve 13 connected with a gas supply valve tube 130 is installed at the top of the support 101, and a flexible plastic feeder case 112 is connected to an end of the feeding chamber 110, and a gas discharge valve tube 131 installed at the rear side of the plastic feeder case 112 as shown in FIGS. 2 to 4 or a connector 132 as shown in FIGS. 5 and 6 is provided for the connection, so that the shooting device of the gun 2 strikes and starts the valve body 14, and the valve body 14 is connected by the gas supply valve tube 130 and the valve 13.

In the actual assembly, a user unloads the magazine 1 from the gun 2 or installs a spare magazine 1 into the gun 2 by pulling or pushing the end of the feeding chamber 110 of the magazine 1 to move an elastic bracket to press the feeder bracket 224 and the feeder spring 113 to load paintballs or pellets 4 into the feeding chamber 110 without completely unloading the support 101. The compressed gas cylinder 12 is installed into the bottom frame 10 from a side of the magazine body 10 through the through holes 100 and slightly rotated in a reverse direction manually or by a tool to be secured onto the bottom of the support 101, so as to quickly install or change a compressed gas cylinder 12. The compressed gas cylinder is pushed upward and the valve 13 pierces the interior interconnected to compressed gas cylinder 12 to control the discharge of compressed gas in the cylinder through the gas supply valve tube 130. After the magazine 1 and the feeding chamber 2 are assembled, the valve body 14 is interconnected to the gun 2, and the paintballs or pellets at an end of the feeding chamber 110 of the magazine 1 are moved to the shooting position in a gun barrel through the sliding case. As to the integral loading and unloading of paintballs or pellets 4 and the compressed gas cylinder 13, a convenient and fast installation is provided. Further, the compressed gas cylinder 12 is installed into the cylinder frame 102 from a side of the magazine body 10 through the through holes 100, so that the left and right sides of the compressed gas cylinder 12 are interconnected to the outside directly to achieve a better heat dissipating effect, and prevent an increase of close space due to the high temperature and a decrease of propelling force during continuous shootings. If the original valve body 14 and plastic feeder case 112 installed on the gun 2 are moved onto the magazine 1, a flexible plastic feeder case 112 is installed at an end of feeding chamber 110 of the magazine body 10, and a valve body 14 connected to the gas discharge valve tube 131 or a connector 132 is installed, so that after the magazine 1 is installed onto the gun 2, the paintballs or pellets 4 in the feeder case 112 at the end of the feeding chamber 110 are located at a shooting position or pushed from the plastic feeder case 1 to the shooting position in the gun barrel by the connector 132. Since the gas discharge valve tube 131, gas supply valve tube 130, plastic feeder case 112 and valve body 14 are an integral sealed structure, there will be no risk of gas leakage at the gap between the gun 2 and the magazine 1, and thus improving the propelling force and extending the use time of the compressed gas cylinder.

In summation of the description above, the structure and device of the present invention are novel, not only providing a quick and convenient way for carrying, loading or unloading paintballs or pellets and the compressed gas cylinder, but also providing a good heat dissipating effect. The present invention has significant improved effect and also complies with the patent application requirements. The description and its accompanied drawings are used for describing preferred embodiments of the present invention, and it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A cartridge magazine assembly for air guns and paintball guns, comprising a magazine body, a feeding device, a compressed gas cylinder and a valve; wherein said magazine body has a feeding chamber vertically disposed at a front edge of said magazine body and said feeding device comprised of a feeder spring pushes a feeder bracket installed in said feeding chamber, a cylinder frame with through holes disposed on the sides of said magazine body, and said compressed gas cylinder installed through any one of the through holes, a support screwed to the bottom of said cylinder frame for pushing said cylinder to move vertically up and down, said valve connected to a gas supply valve tube and installed on the top of said cylinder frame, thereby said magazine assembly is inserted into a breech of a gun to connect to a shooting and feeding device of said gun.

2. The cartridge magazine assembly for air guns and paintball guns of claim 1, wherein said feeding chamber has a casing for changing the hole diameter of said feeding chamber for feeding paintballs or pellets of different sizes.

3. The cartridge magazine assembly for air guns and paintball guns of claim 1, wherein said magazine body has a flexible plastic feeder case disposed on an end of said feeding chamber of said magazine body, and a valve is installed at a rear side of said plastic feeder case and connected to said gas discharge valve tube for striking a shooting device of said gun and being connected to said valve by said gas supply valve tube.

4. The cartridge magazine assembly for air guns and paintball guns of claim 1, wherein said magazine body has a flexible plastic feeder case disposed on an end of said feeding chamber of said magazine body, and a valve is installed at a rear side of said connector and connected to said gas discharge valve tube for striking a shooting device of said gun and being connected to said valve by said gas supply valve tube.

* * * * *